US005860794A

United States Patent [19]

Hand et al.

[11] Patent Number: 5,860,794

[45] Date of Patent: Jan. 19, 1999

[54] DOUBLE DIAPHRAGM PUMP WITH AIR VALVE BLOCK MOVING IN A RECTANGULAR PATTERN

[75] Inventors: Kent P. Hand, Coon Rapids; Ann C. Feitel, Plymouth; Joel T. Fisher, St. Paul; Harold D. Johnson, Buffalo; Graig D. Burt, Plymouth, all of Minn.

[73] Assignee: Graco Inc, Minneapolis, Minn.

[21] Appl. No.: 837,237

[22] Filed: Apr. 10, 1997

[51] Int. Cl.[6] ..... F04B 35/00

[52] U.S. Cl. ..... 417/393; 91/286; 91/311; 91/312; 91/314; 417/395

[58] Field of Search ..... 417/393, 395; 91/286, 311, 312, 313, 348, 314

[56] References Cited

U.S. PATENT DOCUMENTS 2,748,752 6/1956 Baghuis ..... 121/157

*Primary Examiner*—Timothy Thorpe
*Assistant Examiner*—Ehud Gartenberg
*Attorney, Agent, or Firm*—Douglas B. Farrow

[57] ABSTRACT

An air operated double diaphragm pump is provided with an air valve assembly which allows the valve cup to move in a rectangular pattern.

2 Claims, 10 Drawing Sheets

DOUBLE DIAPHRAGM PUMP WITH AIR VALVE BLOCK MOVING IN A RECTANGULAR PATTERN

BACKGROUND OF THE INVENTION

Air operated double diaphragm pumps have been a popular product for many years and are widely used for the transfer of fluids and other uses. Such pumps are manufactured by a variety of producers using a number of different designs. While a variety of such designs have proven successful in the marketplace, it is always desirable to be able to reduce the manufacturing cost of such products and in general that often means reducing the parts count involved in such a product.

SUMMARY OF THE INVENTION

It is therefore an object of this invention to produce an air operated double diaphragm pump which utilizes a substantially lesser number of parts than prior art designs and yet which is easily manufactured, easily assembled, and reliable in operation for the consumer.

Towards this end, the design of the instant invention utilizes a number of features which serve to achieve this end and which make the product more user friendly and adaptable for the end-user.

An air valve which moves in a rectangular path is provided which greatly reduces the parts count for a diaphragm pump air valve. A valve carriage carries a valve cup and has pistons at either end which are driven by pilot air off of two of the five ports located underneath the valve cup. The area over the valve plate and valve cup is pressurized with air effectively forming a sixth port and thus ports which are not covered by the valve cup are pressurized by high pressure plant air. Thus, the valve cup is moved in a first direction by the valve carriage and in the second direction normal to the first direction by pins which are driven by the main diaphragm assembly.

Molded threads on the manifold base are such as to allow use of either an American pipe thread (NPT) or British standard pipe thread (BSP). The pump is provided with a manifold base to which system plumbing is connected so that when it is desired to service or replace the pump, several conventional fasteners need merely be loosened such that the main portion of the pump is lifted off the base and either serviced or replaced and then replaced into position without having to loosen or unseal the fluid fittings. "O" rings provide a sealing assembly between the base and the main fluid section.

A one-piece check valve construction is utilized with the part having a central sealing disk having a plurality of radially axially extending guide members extending therefrom wherein each of the guide members has an outer diameter sized to slidingly fit within a cylindrical cavity and each of the guide members having axially opposite the sealing disk a plurality of circumferentially extending spring loaded fingers which serve to bias the check valve into a closed position.

The main portion of the pump, that is, the center section and fluid housing, is designed to fasten to a manifold base which contains the check valves and also which has threaded connections for connection to fluid lines for plumbing purposes. If it is desired to service the pump for various reasons, the main portion of the pump may be removed from the base without the need to unthread and disconnect the fluid fittings. This removal also allows direct access and replacement of the check valves without the need to further disassemble the pump.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
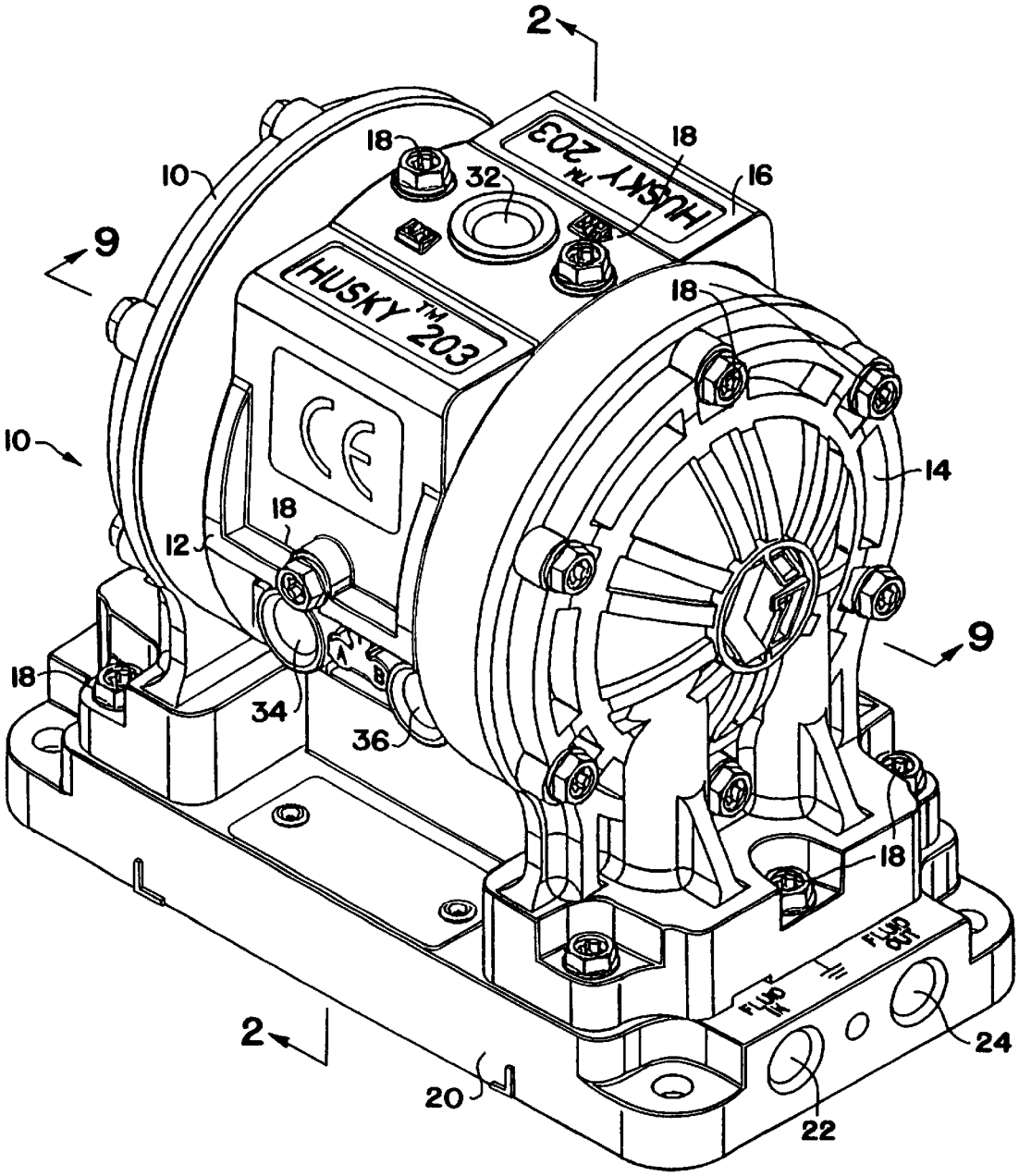
FIG. 1 is a perspective view of the instant invention.

The instant invention generally designated 10 is shown in FIG. 1 in perspective and is comprised of a molded center section 12, two fluid end sections 14 and a valve cover 16. In the preferred embodiment, center section 12 is molded of polyester resin (PBT) Valox 357—GE Plastic.

Cover 16 is fixed via conventional fasteners 18 to center section 12. Also affixed via fasteners 18 to center section 12 are fluid housings 14. The main portion of the pump comprised of center section 12 and fluid housing 14 is affixed to manifold base 20 also via fasteners 18. Manifold base 20 has fluid inlet and outlet passages 22 and 24 respectively located at each end to allow variety in plumbing arrangements.

Figure 3:
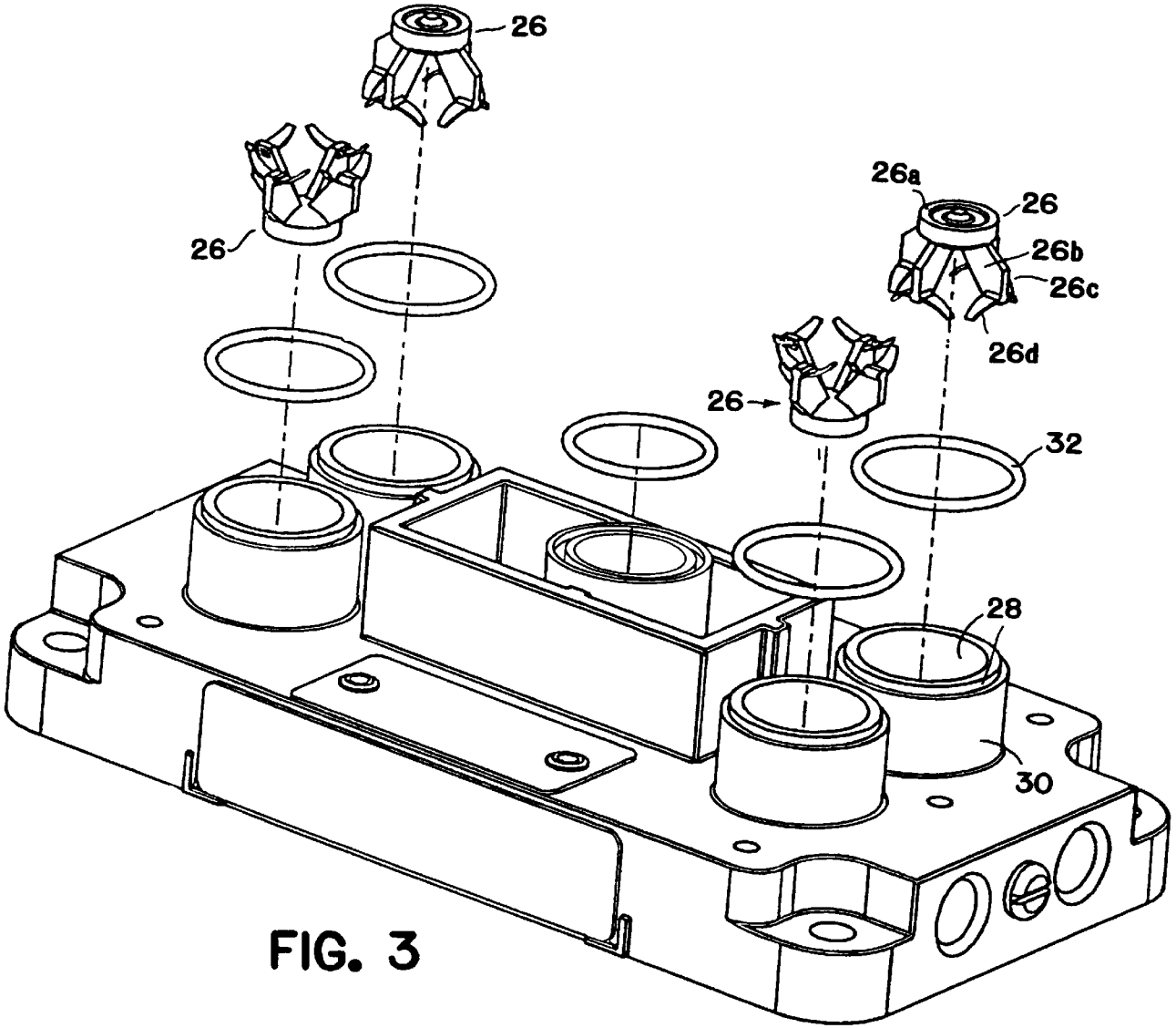
FIG. 3 is a partially exploded view of the manifold base and check valves.
Figure 4:
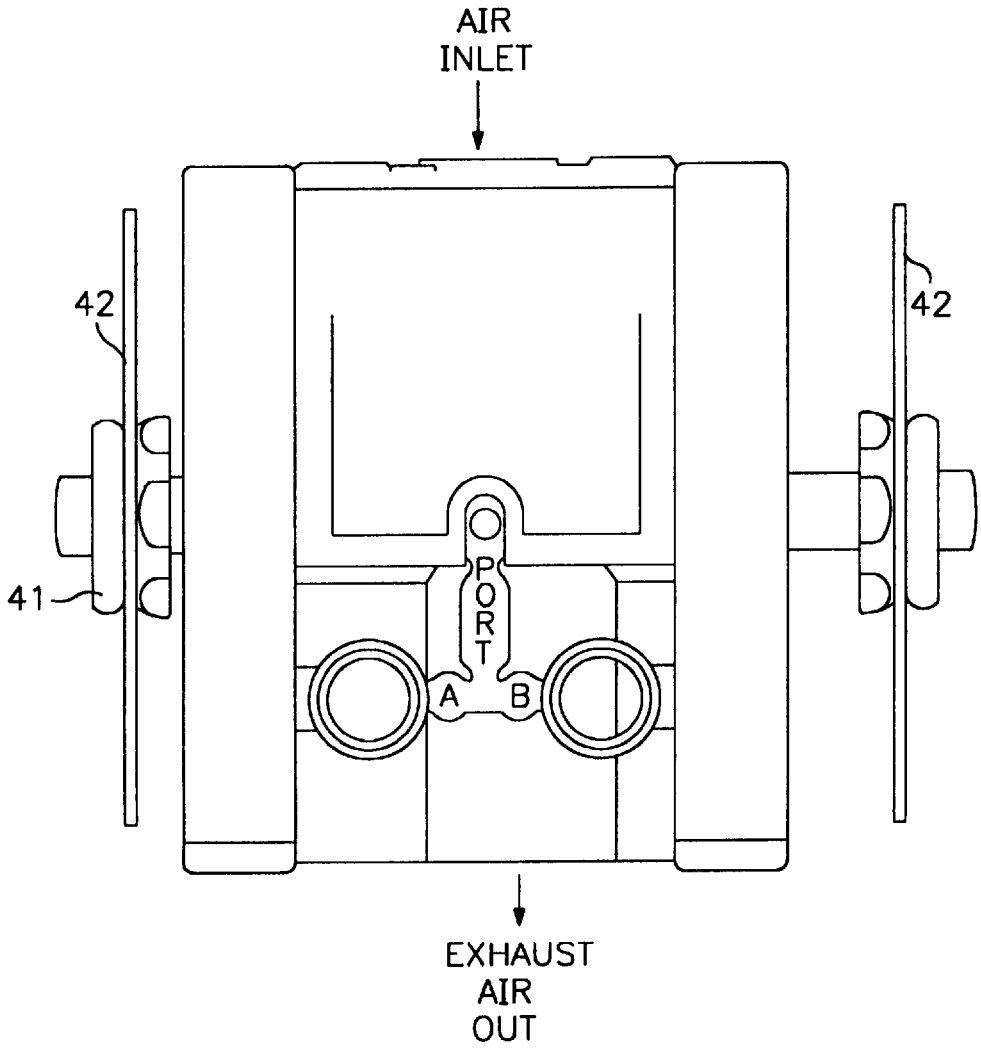
FIG. 4 is a plan view of the center section and diaphragms.

Turning more specifically to FIG. 3, check valves 26 are each comprised of a central sealing area 26A having in the preferred embodiment four radially and axially extending arms 26B extending therefrom and having a surface 26C which closely positions check valve 26 in check valve passages 28. Spring loaded fingers 26D extend from either side of arm 26B and act against the bottom or top of passage 28 to bias check valve 26 into the closed position where it will remain unless fluid pressure against sealing area 26A should press it open. The radially extending guide members 26B also act as a stop. The spring fingers 26D compress and the top of the guide arms 26C butts up against the fluid cover 14 on the inlet check and the manifold base 20 on the outlet check. This limits the check valve travel.

Members 30 on base 20 containing passages 28 are sealed to fluid body 14 by means of seals 32 carried at the end thereof.

Returning to FIG. 1, cover 16 has an air inlet 32 which pressurizes the area underneath cover 16. First and second auxiliary ports 34 and 36 respectively are located in the side of center housing 14 for direct connection of air from solenoid valves if it is desired to have the pump controlled remotely rather than through the integral air valve. The integral ports 34 and 36 make it easy to change a pump from air valve operated to a remotely operated pump by removing the air valve cup and replacing it with an air valve plug.

Figure 2:
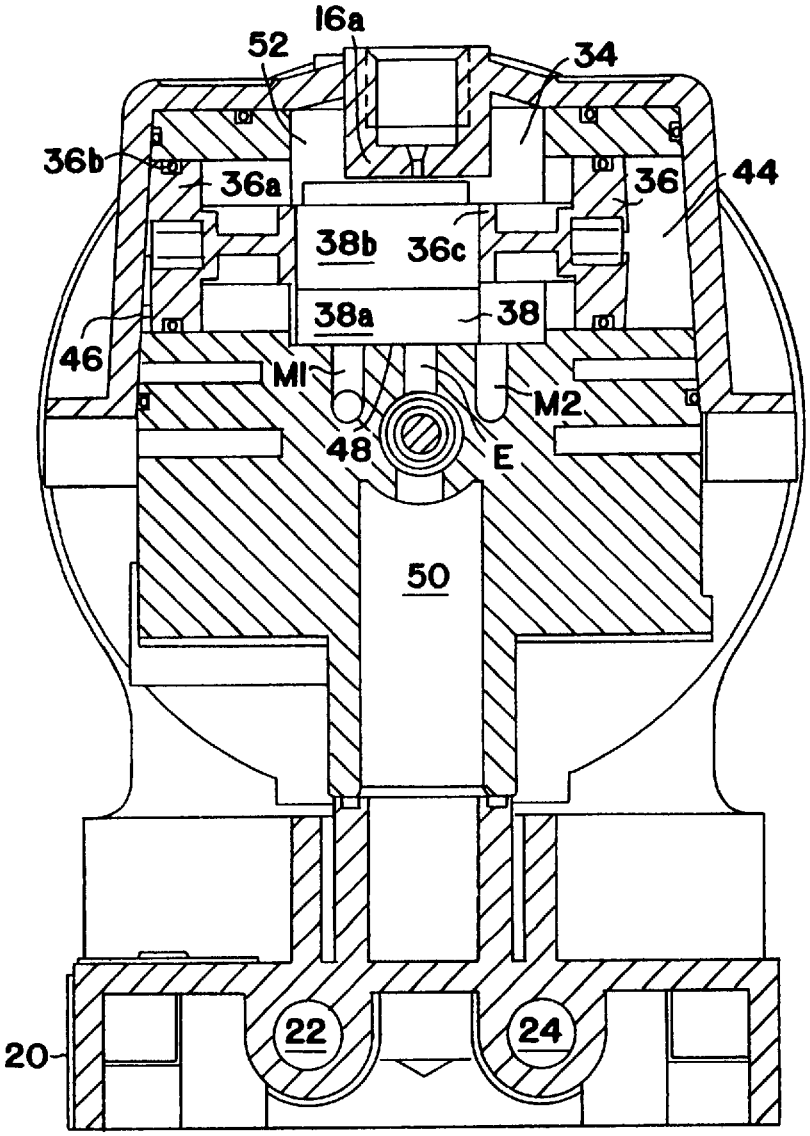
FIG. 2 is a sectional view taken along line 2—2 of FIG. 1.
Figure 9:
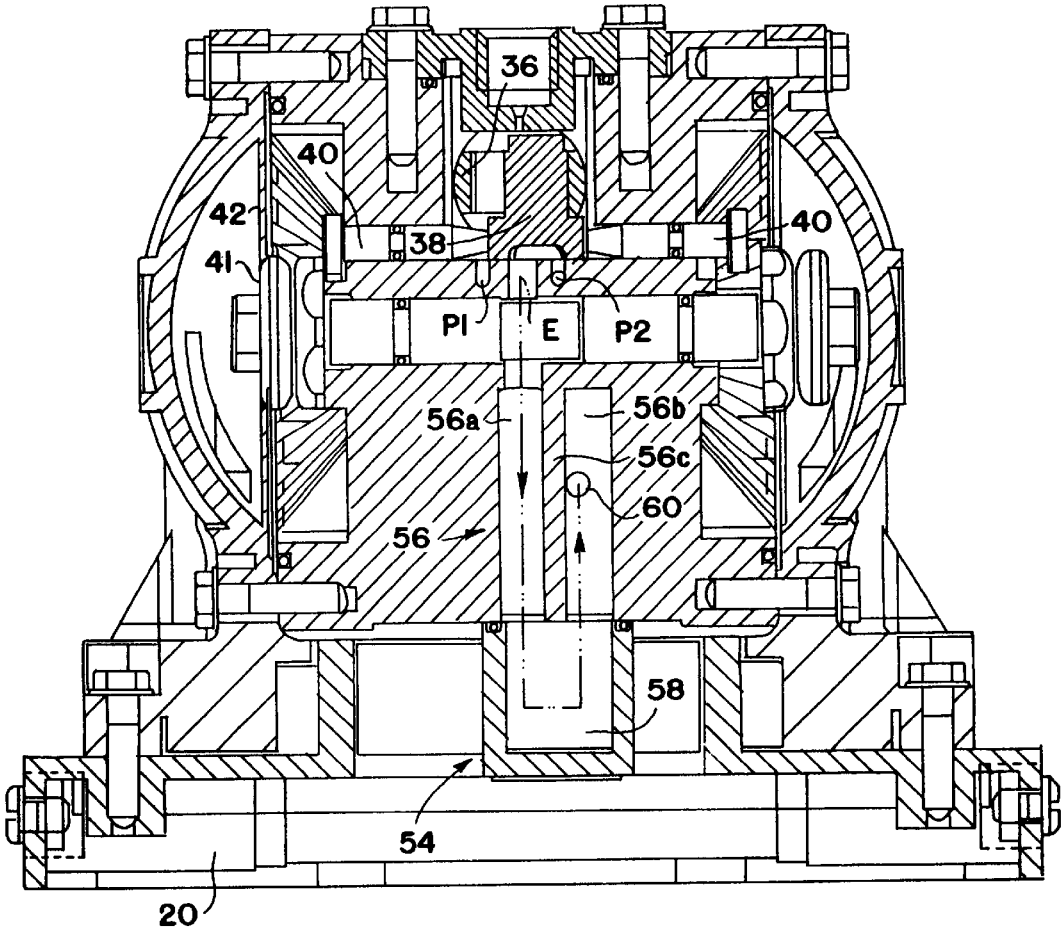
FIG. 9 is a sectional view taken along line 9—9 of FIG. 1.
Figure 10:
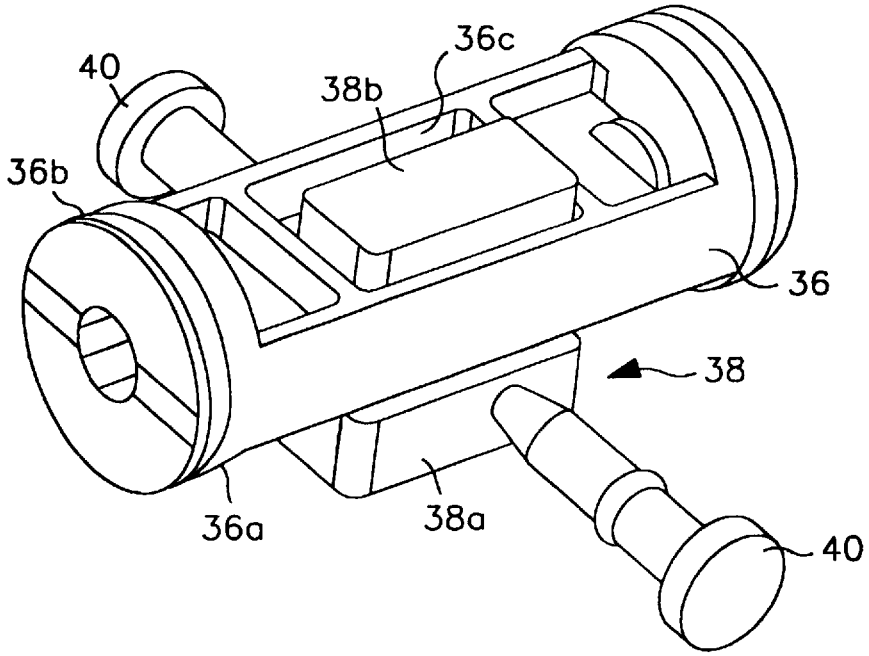
FIG. 10 is a perspective view showing the valve carriage and valve block.

Turning to FIGS. 2, 9 and 10, the air valve assembly is comprised of a valve carriage 36 which has generally cylindrical end portions 36A having seals 36B thereon, a rectangular central aperture 36C which retains moveable valve block 38. Valve block 38 has a lower sealing section 38A and a central section aperture 36C and carriage 36 which thereby allows valve block 38 to move normal to the plane of FIG. 2. This movement occurs due to pushing on block 38 by means of pins 40 which are actuated by diaphragm mounting block 41 in the center of diaphragm 42. In the preferred embodiment, valve block 38 is formed of 90 Durometer XNBR (Carboxylated Nitrile) with 10% TFE powder to reduce friction.

As seen in FIG. 2, air passages M1 and M2 connect to the main air chambers on the inner side of diaphragm assemblies 42 for pressurizing the air chambers with compressed air as will be more fully described in the operation of the air valve hereinafter. Passages P1 and P2 connect to air chambers 44 and 46 respectively, passages P1 and P2 running as shown in the drawings as straight passages and thence are covered and connected to chambers 44 and 46 by cover 16.

Valve block 38 is retained in place in valve carriage 36 by boss 16A on cover 16. To disassemble the valve assembly, one merely need remove fasteners 18 from cover 16 and lift cover 16 off whereupon valve block 38 is lifted upwardly thereby allowing valve carriage 36 to be slid out of center housing 16.

FIGS. 5–8 show a view of the valve port surface 48 which has five ports therein. Central exhaust port E is connected to the exhaust passage 50 while pilot ports P1 and P2 are connected to first and second ends respectively of the pilot valve carriage 36. Similarly, main ports M1 and M2 are connected to first and second diaphragm air chambers respectively. The area 52 above the ports referred to is generally filled with compressed air and ports which are not covered by the valve block 38 are pressurized with the compressed air.

Figure 5:
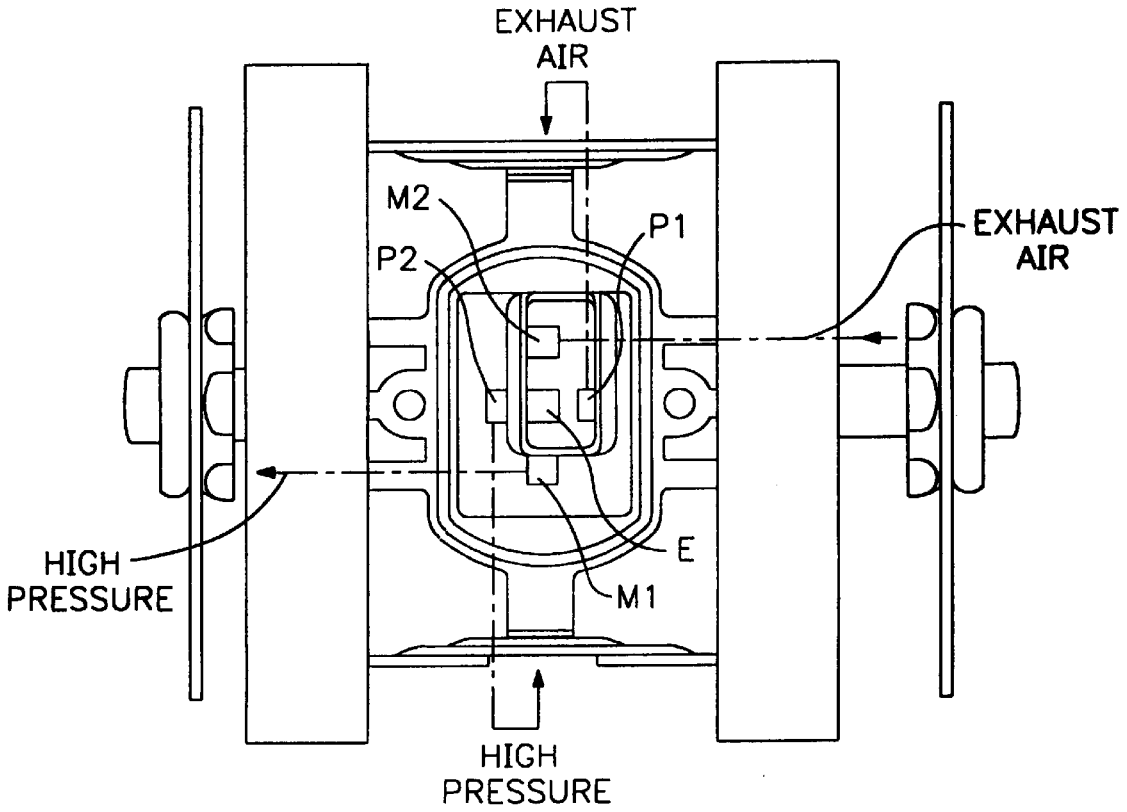
FIGS. 5–8 show the air valve in its sequence of operation.
Figure 6:
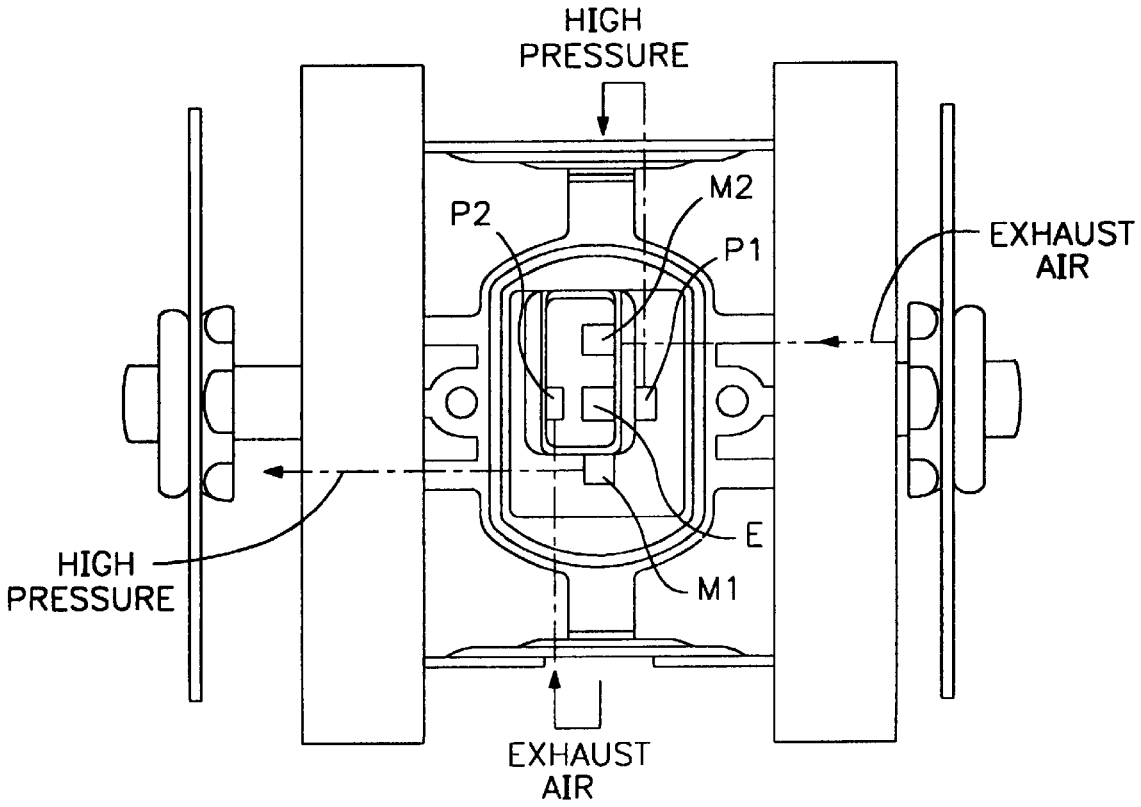
Figure 7:
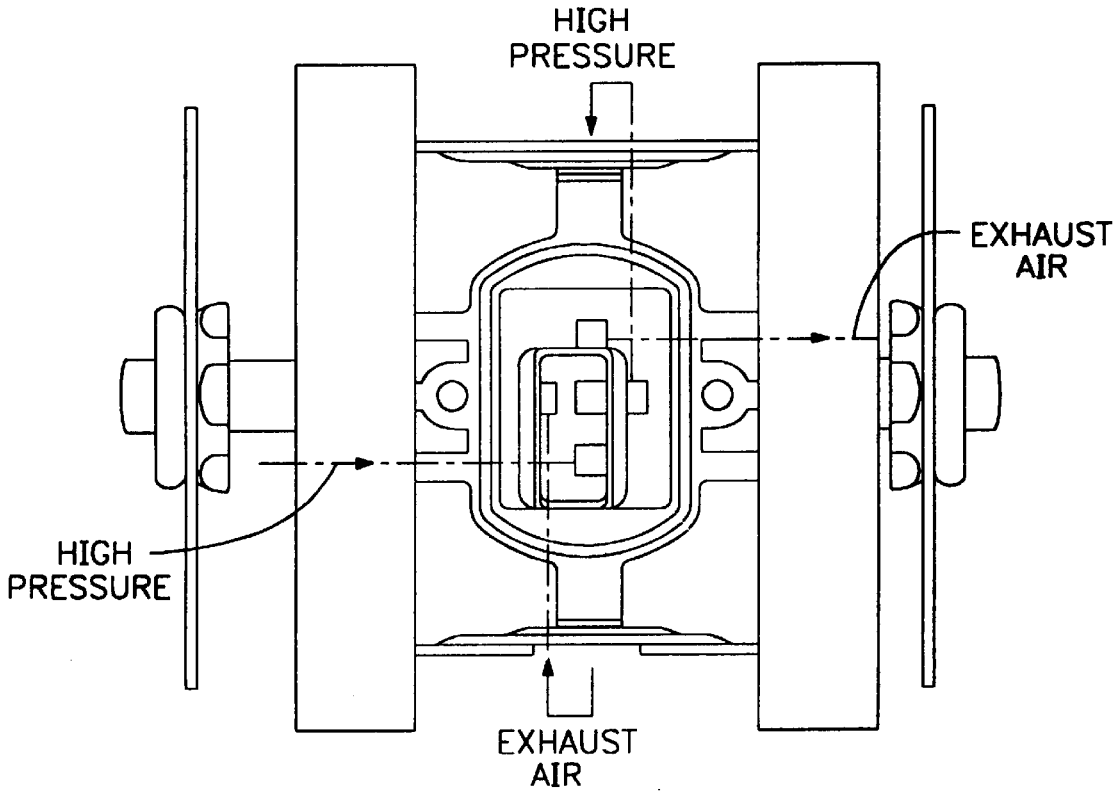
Figure 8:
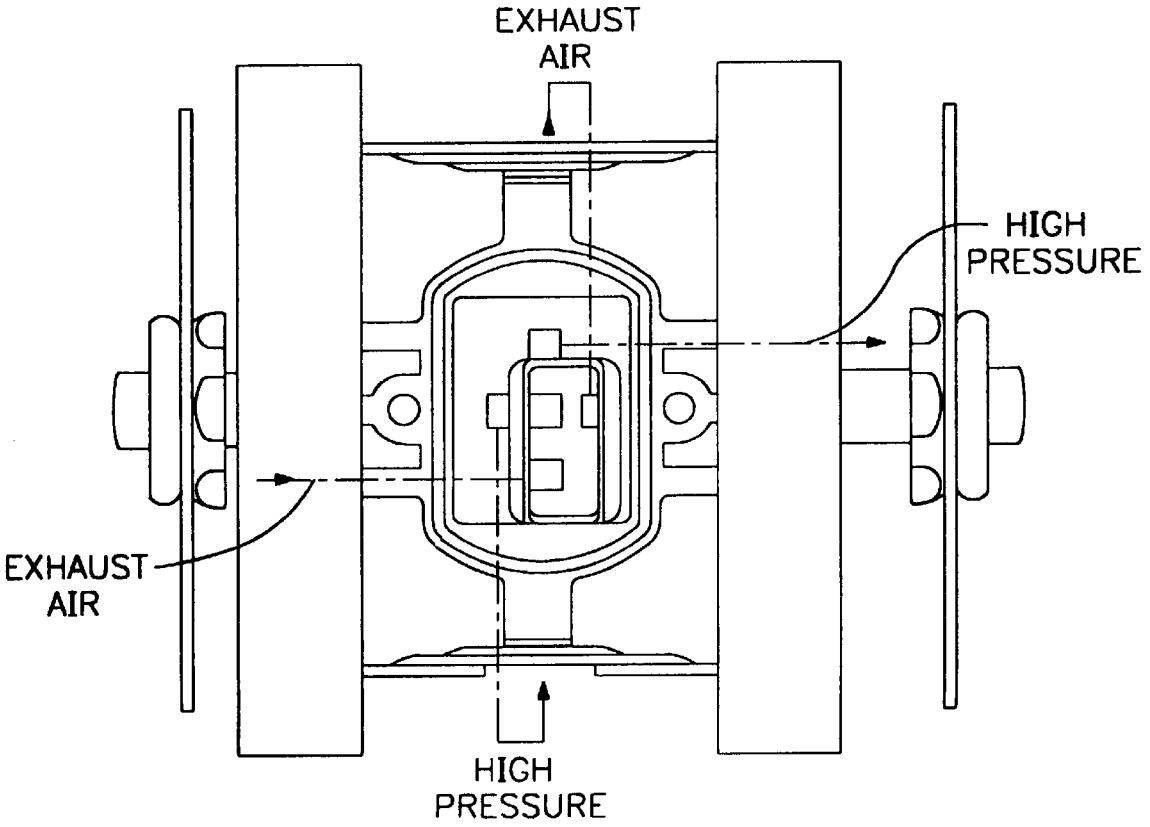

In general, two adjacent ports and the exhaust port E are always covered and connected at one time while the other two adjacent ports are fed with compressed air. If we start with the valve block 38 in the upper right hand position as shown in FIG. 5, ports M2 and P1 are connected to exhaust port E while compressed air is fed to ports M1 and P2. In this situation, the pilot valve carriage 36 is at the upward end of its travel while the diaphragms are approaching the left end of their travel whereupon the pins 40 driven by the diaphragms 42 push the valve block 38 to the upper left hand position shown in FIG. 6 which connects compressed air to ports M1 and P1 while exhausting ports P2 and M2. This pressurizes the upper end of the pilot valve carriage 36 and moves the pilot 36 downwardly and the valve block 38 into the lower left hand position of FIG. 7 whereupon compressed air is connected to ports P1 and M2 and ports M1 and P2 exhaust.

At that point, the diaphragms are moving together to the right while the pilot is in the down position. As the pilots reach the rightward end of their stroke, the valve block 38 is moved into the lower right hand position of FIG. 8 whereupon compressed air is fed to ports P2 and M2 while ports P1 and M1 are exhausted. This pressurizes the lower end of the pilot 36 and the pilot 36 moves upwardly to the point where the description started above.

It can be noted that a very low number of parts is required to produce this valve. The ends of the chambers for the pilot valve carriage 36 are completed by the valve cover 16 which also covers the top of the valve cavity at the same time.

The inlet threads on the manifold base are such that it allows use of either an American pipe thread (NPT) or British standard pipe thread (BSP). This hybrid thread may be formed in plastic parts and is intended to form a pressure tight joint with either plastic or brass male pipe threaded fitting of either type thread. The thread is defined as follows:

Major diameter 0.518"
Pitch 0.4843"
Minor diameter 0.4506"
Angle 1 degree 47 minutes
Threads per inch 18.6
Effective thread 0.402"

The muffler 54 is best seen in FIG. 9. Exhaust port E leads to cylindrical passage 56 which is divided into first and second portions 56A and 56B by divider 56C. The passage is completed by a muffler area 58 in manifold base 20. Hence, exhaust flows out port E, into first portion 56A and into muffler area 58 whereupon it flows upwardly through second portion 56B and out through muffler outlet 60. This arrangement allows substantial muffling at low cost and with little penalty to performance.

It is contemplated that various changes and modifications may be made to the pump without departing from the spirit and scope of the invention as defined by the following claims.

What is claimed is:

1. In a reciprocating air operated pump having pumping elements which reciprocate along a first axis, an air valve comprising:

a valve carriage moveable along a second axis normal to said first axis;

a valve block moveable in said valve carriage along said first axis;

a valve surface comprising first and second main ports; first and second pilot ports and an exhaust port;

means for causing said valve block to move as said pumping elements move; and means for supplying compressed air over said valve surface and wherein said valve block moves in a generally planar rectangular path between four positions, wherein in each of said positions, said valve block connects a main port, a pilot port and said exhaust port.

2. The pump of claim 1 wherein said pump further comprises pilot chambers at each end of said valve carriage, each said pilot port being connected to one of said chambers.

* * * * *